US008488990B2

(12) United States Patent
Sato et al.

(10) Patent No.: US 8,488,990 B2
(45) Date of Patent: Jul. 16, 2013

(54) HOUSING UNIT AND IMAGE FORMING APPARATUS

(75) Inventors: Hiroyuki Sato, Chigasaki (JP); Atsuna Saiki, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 224 days.

(21) Appl. No.: 13/154,066

(22) Filed: Jun. 6, 2011

(65) Prior Publication Data

US 2012/0099893 A1 Apr. 26, 2012

(30) Foreign Application Priority Data

Oct. 25, 2010 (JP) ..... 2010-238481

(51) Int. Cl.
*G03G 15/00* (2006.01)
*G03G 15/16* (2006.01)
*G03G 15/02* (2006.01)

(52) U.S. Cl.
USPC ..... 399/107; 399/122; 399/116

(58) Field of Classification Search
USPC ..... 399/107, 110, 111, 113, 114, 122, 399/400, 398, 399, 397, 94, 96
See application file for complete search history.

(56) References Cited

FOREIGN PATENT DOCUMENTS

JP 11-065361 A 3/1999

*Primary Examiner* — David Gray
*Assistant Examiner* — Sevan A Aydin
(74) *Attorney, Agent, or Firm* — Sughrue Mion, PLLC

(57) ABSTRACT

A housing unit includes: a first housing that contains a cylindrical image holder; a second housing that contains a fuser unit for fixing an image to a recording medium by a heat roller; a protruding unit that protrudes outwardly from a surface of the first housing, which surface faces a circular surface of the image holder; a heat resistant member that is formed of a material having heat resistance higher than that of the protruding unit, and covers the protruding unit; a metallic supporting unit that supports an end of the heat roller; a connecting unit that is formed on the supporting unit and is shaped to contact and fit the heat resistant member; and a fixing unit that fixes the first housing to the second housing at such a position that the connecting unit is fitted to the heat resistant member.

5 Claims, 4 Drawing Sheets

HOUSING UNIT AND IMAGE FORMING APPARATUS

CROSS-REFERENCE TO RELATED APPLICATIONS

This application is based on and claims priority under 35 U.S.C. 119 from Japanese Patent Application No. 2010-238481 filed on Oct. 25, 2010.

BACKGROUND

1. Technical Field

The present invention relates to a housing unit and an image-forming apparatus.

2. Related Art

In some image-forming apparatuses, a fusing process is performed by use of a heat roller and pressure roller.

SUMMARY

According to an aspect of the invention, there is provided a housing unit including: a first housing that contains a cylindrical image holder on which an image is formed; a second housing that contains a fuser unit for fixing, after the image is transferred from the image holder to a recording medium, the image to the recording medium by a heat roller; a protruding unit that protrudes outwardly from a surface of the first housing, which surface faces a circular surface of the image holder; a heat resistant member that is formed of a material having heat resistance higher than that of the protruding unit, and covers the protruding unit; a metallic supporting unit that supports an end of the heat roller; a connecting unit that is formed on the supporting unit and is shaped to contact and fit the heat resistant member; and a fixing unit that fixes the first housing to the second housing at such a position that the connecting unit is fitted to the heat resistant member.

BRIEF DESCRIPTION OF THE DRAWINGS

Exemplary embodiments of the present invention will be described in detail based on the following figures, wherein.

DETAILED DESCRIPTION

Figure 1:
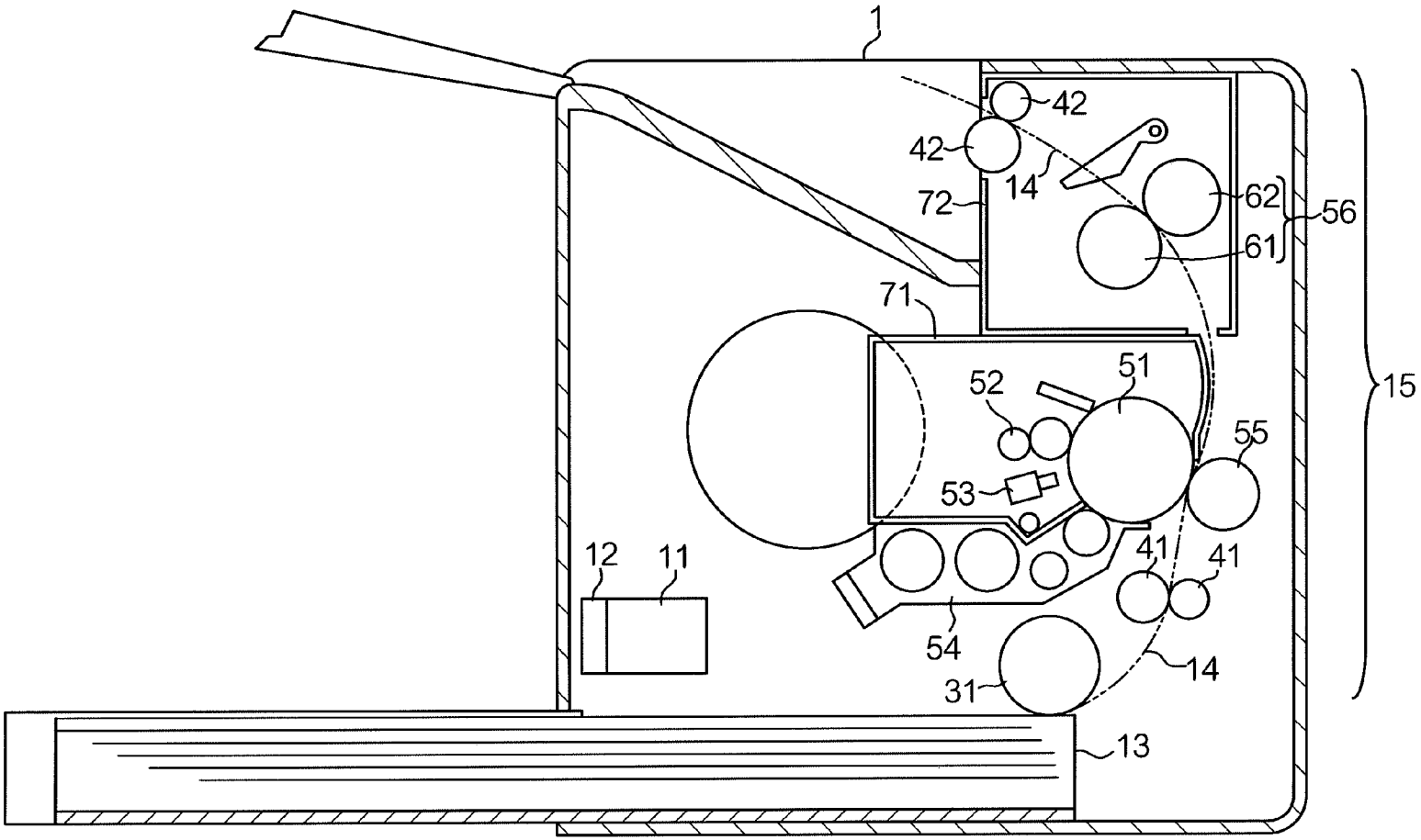
FIG. 1 is a schematic diagram showing a configuration of an image-forming apparatus.

FIG. 1 is a schematic diagram showing a configuration of image-forming apparatus 1 according to the present exemplary embodiment. Image-forming apparatus 1 includes controller 11, communication unit 12, paper supply unit 13, transport unit 14, and image-forming unit 15. Controller 11 includes a Central Processing Unit (CPU) and a memory. Controller 11 controls each component of image-forming apparatus 1 by execution of a program stored in the memory by the CPU. Communication unit 12 performs data communication with a computer device via a communication line. For example, controller 11 receives image data from a computer device via communication unit 12. Paper supply unit 13 contains plural recording mediums. Paper supply unit 13 includes paper supply roller 31. Paper supply roller 31 sends a single recording medium from paper supply unit 13. Transport unit 14 transports the recording medium from paper supply unit 13 to the outside of image-forming apparatus 1 via image-forming unit 15. Transport unit 14 includes transport rollers 41 and paper exit rollers 42. Transport rollers 41 receive a recording medium from paper supply unit 13, and transport the recording medium at such timing that an image is transferred onto the recording medium. Paper exit rollers 42 receive a recording medium passed through image-forming unit 15, and cause the recording medium to exit from image-forming apparatus 1.

Image-forming unit 15 includes photoconductive drum 51, charging device 52, exposure device 53, development device 54, primary transfer roller 55, and fuser device 56. Photoconductive drum 51 (an example of an image holder) is of a cylindrical shape. Photoconductive drum 51 is caused to rotate by a drive unit such as a motor (not shown). Charging device 52 (an example of a charging unit) uniformly charges the surface of photoconductive drum 51 to a predetermined potential. Exposure device 53 (an example of an exposure unit) irradiates the surface of charged photoconductive drum 51 with a laser beam to form an electrostatic latent image. When irradiating photoconductive drum 51, exposure device 53 modulates a laser beam based on image data received from a computer device. Developing device 54 develops an electrostatic latent image formed on photoconductive drum 51 with a toner to form an image. Primary transfer roller 55 (an example of a transfer unit) transfers an image formed on photoconductive drum 51 onto a recording medium (e.g., a paper) transported by transport rollers 41. Fuser device 56 (an example of a fuser unit) includes heat roller 61 and pressure roller 62. Fuser device 56 applies heat and pressure to an image formed on a recording medium to fix the image to the recording medium. After passing fuser device 56, a recording medium is exited from image-forming apparatus 1 by paper exit rollers 42.

Figure 2:
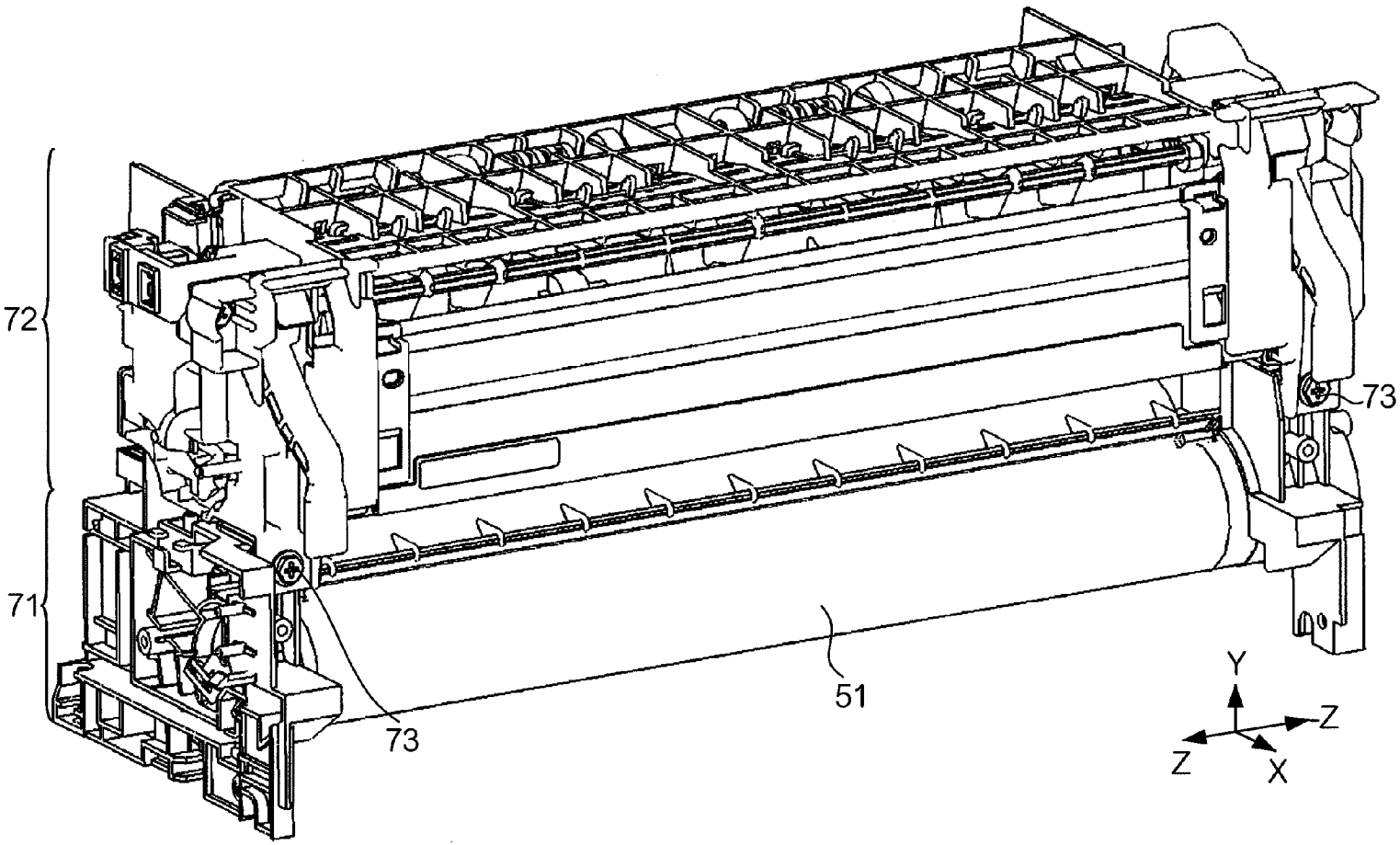
FIG. 2 is a diagram showing housing 71 and housing 72.
Figure 3:
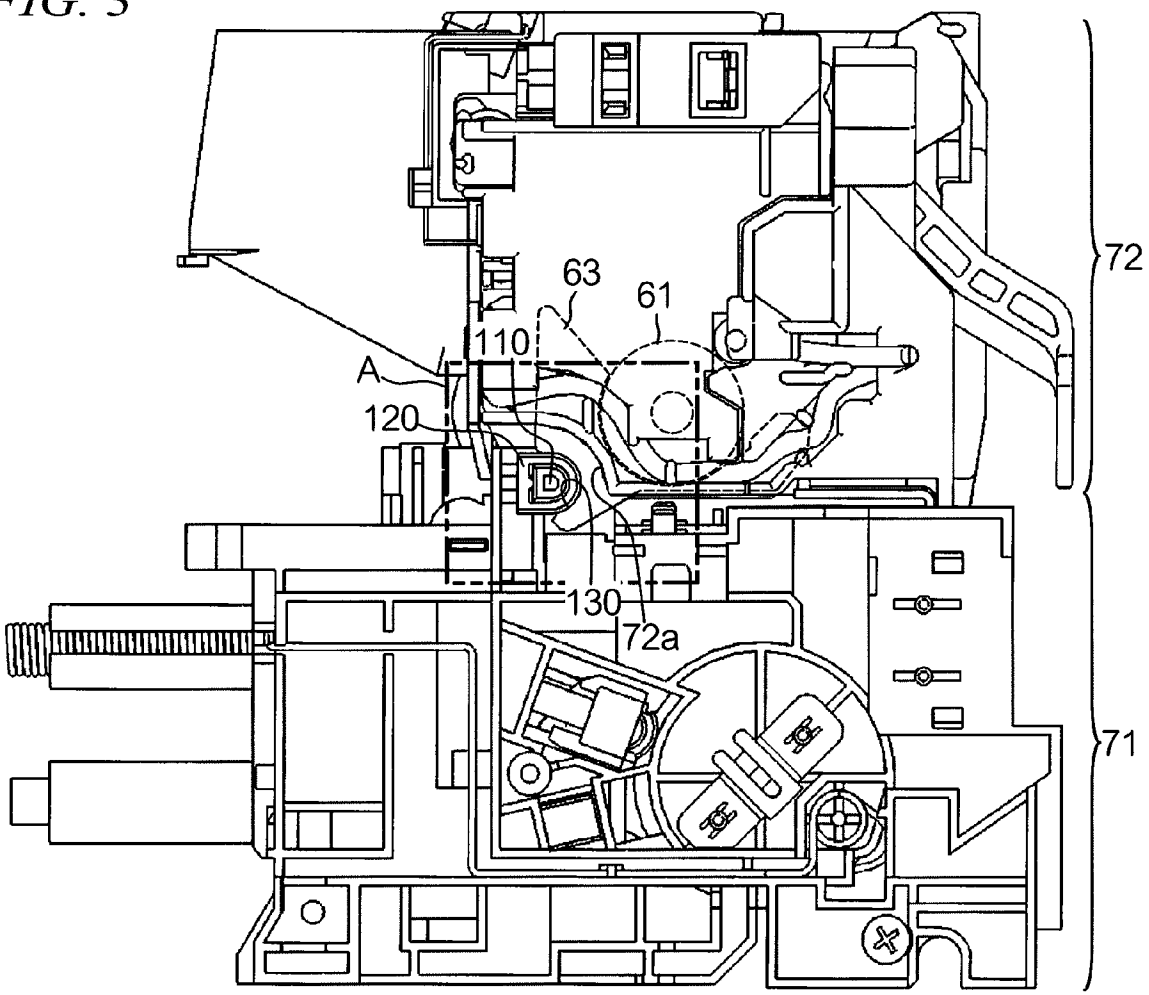
FIG. 3 is a side view of housing 71 and housing 72 in a direction indicated by arrow −Z of FIG. 2.

Housing 71 (an example of a first housing) contains photoconductive drum 51, charging device 52, and exposure device 53. Housing 72 (an example of a second housing) contains fuser device 56. FIG. 2 is a diagram showing housing 71 and housing 72. Housing 71 and housing 72 are formed of ABS resin. Housing 72 is disposed on housing 71. FIG. 3 is a side view of housing 71 and housing 72 in a direction indicated by arrow −Z of FIG. 2. It is to be noted that although FIG. 3 shows a structure of one side of housing 71 and housing 72, the other side has the same structure as the one side. Also, in FIG. 3 pressure roller 62 is omitted. Heat roller 61 is provided in a lower part of housing 72. Supporting unit 63 supports an end of heat roller 61. More specifically, supporting unit 63 supports a bearing (not shown) provided at an end of heat roller 61.

Figure 4:
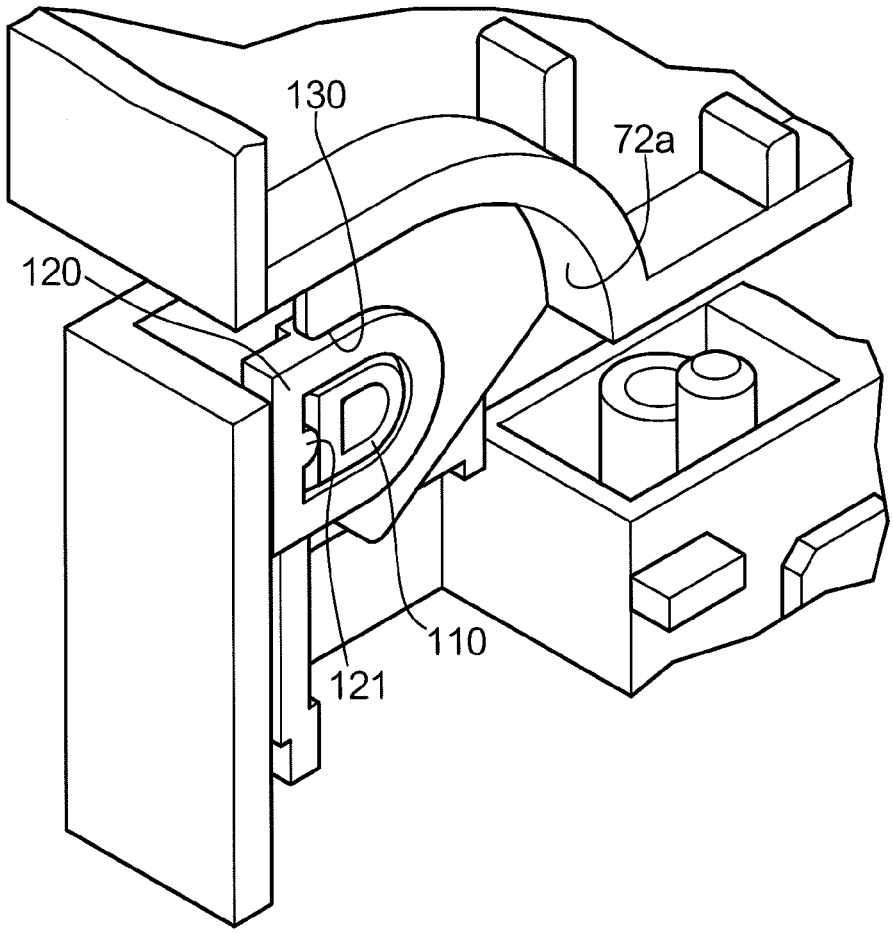
FIG. 4 is a perspective view schematically showing magnified part A of FIG. 3.
Figure 5:
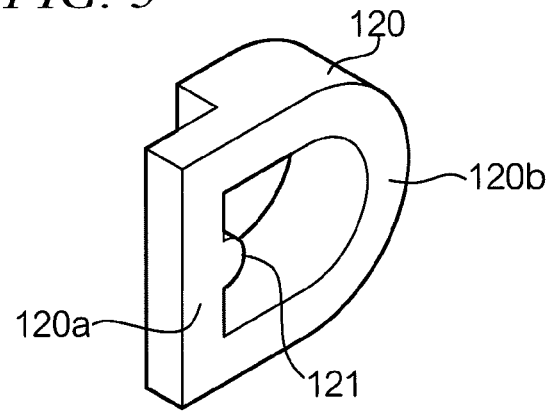
FIG. 5 is a diagram showing a heat resistant member.

FIG. 4 is a perspective view schematically showing magnified part A of FIG. 3. Protruding unit 110 is provided on a side of housing 71. The side faces a circular surface of photoconductive drum 51. Protruding unit 110 is formed of ABS resin as housing 71. Protruding unit 110 has a D-shaped outline. Protruding unit 110 protrudes outwardly from a side of housing 71. Protruding unit 110 serves as a positioning boss of fuser device 56. Heat resistant member 120 is fitted to protruding unit 110. FIG. 5 is a diagram showing heat resistant member 120. Heat resistant member 120 has a D-shaped cross section. Heat resistant member 120 covers the outer circumferential surface of protruding unit 110. Heat resistant member 120 is formed of heat resistant resin that has heat resistance higher than that of ABS resin such as polyethylene terephthalate (PET) with glass resin. The polyethylene terephthalate with glass resin is a material having high heat resistance and high rigidity. Heat resistant member 120 includes linear portion 120*a* and arc portion 120*b*. On the inner surface of linear portion 120*a*, protrusion 121 is provided. Protrusion 121 contacts and presses protruding unit 110. Heat resistant member 120 is firmly fixed to protruding unit 110 by protrusion 121.

As is shown in FIG. 3 and FIG. 4, connecting unit 130 is formed at the end of supporting unit 63. Connecting unit 130 is of such a U-shaped form as contacts and fits arc portion 120*b* of heat resistant member 120. Housing 72 has cut out portion 72*a*. Connecting unit 130 is exposed on the outside of housing 72 from cut out portion 72*a*. Connecting portion 130 is pressed against arc portion 120*b* of heat resistant member 120. Fuser unit 56 is positioned where connecting unit 130 is fitted to arc portion 120*b*. After fuser unit 56 is positioned, housing 71 and housing 72 are fixed by screw 73 (an example of a fixing unit) as shown in FIG. 2.

Heat roller 61 generates heat during a fusing process. Since supporting unit 63 is formed of a metal and has high heat conductivity, supporting unit 63 contacting heat roller 61 has a high temperature (for example, a temperature greater than or equal to 80 degrees) while heat roller 61 generates heat. If heat resistant member 120 is not provided, connecting unit 130 of supporting unit 63 contacts protruding unit 110 directly. ABS resin forming protruding unit 110 is likely to be deformed at a temperature greater than or equal to about 70 degrees when a weight is added to ABS resin. As is described above, protruding portion 110 serves as a positioning boss of fuser device 56. Therefore, if protruding unit 110 is deformed, positioning accuracy of fuser unit 56 is reduced. However, in the present exemplary embodiment, connecting unit 130 of supporting unit 63 contacts protruding unit 110 via heat resistant member 120 that has high heat resistance. Therefore, protruding unit 110 is not much affected by heat and is barely deformed. Accordingly, it is possible to minimize reduction in positioning accuracy of fuser unit 56. If a position of fuser unit 56 is shifted, a recording medium is not transported between heat roller 61 and pressure roller 62 after passing through between photoconductive drum 51 and primary transfer roller 55. To prevent such a problem, it is required that fuser unit 56 is exactly positioned with respect to housing 71.

Also, in the present exemplary embodiment, fuser unit 56 is positioned by supporting unit 63 that supports heat roller 61 directly. Therefore, positioning accuracy of fuser unit 56 increases compared to a case where, for example, positioning is performed between housing 72 and housing 71. Further, in the present exemplary embodiment, fuser unit 56 is positioned by metallic supporting unit 63. Therefore, positioning accuracy of fuser unit 56 is increased compared to a case where fuser unit 56 is positioned by a member that is formed of a material having low rigidity, such as ABS resin.

Modifications

The present invention is not limited to the above exemplary embodiment, but may be implemented in the embodiment modified as described below. Also, the following modifications may be combined with each other.

Two or more protrusions 121 may be provided with heat resistant member 120. In this case, it is preferable that these protrusions 121 are provided on the inner side of linear portion 120*a* that does not contact connecting unit 130, to avoid obstruction of positioning. Further, protruding unit 110 may have a recess fitting protrusion 121 at a position facing protrusion 121.

A shape of each of protruding unit 110, heat resistant member 120, and connecting unit 130 is not limited to that described in the exemplary embodiment. For example, each of protruding unit 110 and heat resistant member 120 has a concave portion, and connecting unit 130 may be of a convex shape fitting the concave portion. However, to prevent heat resistant member 120 from rotating around protruding unit 110, protruding unit 110 and heat resistant member 120 are of angular shapes.

Protruding unit 110 and heat resistant member 120 may be disposed in an orientation other than that shown in FIG. 3 or FIG. 4. In this case, connecting unit 130 is formed on supporting unit 63 at such a position as to fit arc portion 120*b* of heat resistant member 120 when fuser unit 56 is disposed at a target position.

Heat resistant member 120 may be formed of a material other than polyethylene terephthalate with glass resin if the material has heat resistance higher than protruding unit 110. For example, heat resistant member 120 may be formed of silicone resin.

A method for fixing housing 71 and housing 72 is not limited to a method using screw 73. For example, housing 71 and housing 72 may have male and female structures for fitting each other to fix housing 72 to housing 71.

Housing 71 and protruding unit 110 may be integrally molded, or may be connected after housing 71 and protruding unit 110 are molded as separate bodies. Similarly, heat resistant member 120 and protrusion 121 may be integrally molded, or may be connected after heat resistant member 120 and protrusion 121 are molded as separate bodies.

Housing 71, housing 72, supporting unit 63, protruding unit 110, and heat resistant member 120 may be provided as a housing unit.

Image-forming apparatus 1 may form plural colors of an image. In this case, image-forming apparatus 1 includes photoconductive drum 51, charging device 52, exposure device 53, development device 54, and primary transfer rollers 55 each corresponding to a different color. Also, image-forming unit 15 may form an image on a recording medium other than a paper such as a viewgraph.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments have been chosen and described so that the principles of the invention and its practical applications are explained best, thereby enabling others skilled in the art to understand the invention for use with various embodiments and with various modifications as suited to a particular use contemplated. It is intended that the scope of the invention be defined by the following claims and their equivalents.

What is claimed is:

1. A housing unit comprising:

a first housing that contains a cylindrical image holder on which an image is formed;

a second housing that contains a fuser unit for fixing, after the image is transferred from the image holder to a recording medium, the image to the recording medium by a heat roller;

a protruding unit that protrudes outwardly from a surface of the first housing, which surface faces a circular surface of the image holder;

a heat resistant member that is formed of a material having heat resistance higher than that of the protruding unit, and covers the protruding unit;

a metallic supporting unit that supports an end of the heat roller;

a connecting unit that is formed on the supporting unit and is shaped to contact and fit the heat resistant member; and a fixing unit that fixes the first housing to the second housing at such a position that the connecting unit is fitted to the heat resistant member.

2. The housing unit according to claim 1, wherein:

the heat resistant member includes an arc portion that contacts the connecting unit and a linear portion that does not contact the connecting unit; and the linear portion has a protrusion on an inner side, which protrusion contacts the protruding unit.

3. The housing unit according to claim 1, wherein the heat resistant member is formed of polyethylene terephthalate with glass resin.

4. The housing unit according to claim 2, wherein the heat resistant member is formed of polyethylene terephthalate with glass resin.

5. An image-forming apparatus comprising:

a cylindrical image holder;

a charging unit that charges the image holder;

an exposure unit that exposes the charged image holder to form a latent image;

a development unit that develops the latent image with a toner to form an image;

a transfer unit that transfers the formed image to a recording medium;

a fuser unit that fixes the transferred image to the recording medium by a heat roller;

a first housing that contains the image holder;

a second housing that contains the fuser unit;

a protruding unit that protrudes outwardly from a surface of the first housing, which surface faces a circular surface of the image holder;

a heat resistant member that is formed of a material having heat resistance higher than that of the protruding unit, and covers the protruding unit;

a metallic supporting unit that supports an end of the heat roller;

a connecting unit that is formed on the supporting unit and is shaped to contact and fit the heat resistant member; and a fixing unit that fixes the first housing to the second housing at such a position that the connecting unit is fitted to the heat resistant member.

* * * * *